US005150743A

United States Patent [19]

Walusiak

[11] Patent Number: 5,150,743

[45] Date of Patent: Sep. 29, 1992

[54] APPARATUS FOR ADMITTING METERED QUANTITIES OF LIQUID INTO BOTTLES OR OTHER CONTAINERS

[75] Inventor: Jacek Walusiak, Hamburg, Fed. Rep. of Germany

[73] Assignee: Alfill Getränketechnik GmbH, Hamburg, Fed. Rep. of Germany

[21] Appl. No.: 675,428

[22] Filed: Mar. 26, 1991

[30] Foreign Application Priority Data

Mar. 31, 1990 [DE] Fed. Rep. of Germany ..... 4010413

[51] Int. Cl.[5] ..... B65B 43/42; B67C 3/00

[52] U.S. Cl. ..... 141/147; 141/144; 141/146

[58] Field of Search ..... 141/144-147, 141/39, 40

[56] References Cited

U.S. PATENT DOCUMENTS

| | | | |
|---|---|---|---|
| 1,796,279 | 3/1931 | Berg | 141/147 |
| 2,144,628 | 1/1939 | Hothersall | 141/147 |
| 2,413,194 | 12/1946 | Russell | 141/147 |
| 3,073,359 | 1/1963 | Albrecht et al. | 141/147 |
| 3,097,672 | 7/1963 | Minard | 141/147 |
| 3,168,225 | 2/1965 | Miller et al. | 141/147 |
| 3,335,921 | 8/1967 | Gellatly | 141/147 |

FOREIGN PATENT DOCUMENTS 2257449 5/1974 Fed. Rep. of Germany .

3025786 2/1982 Fed. Rep. of Germany .

*Primary Examiner*—Henry J. Recla
*Assistant Examiner*—Keith Kupferschmid
*Attorney, Agent, or Firm*—Peter K. Kontkler

[57] ABSTRACT

Apparatus for filling successive containers with a liquid, such as a carbonated beverage, has a rotary vessel with a bottom wall which carries an annulus of tubular extensions each of which is surrounded by a metering chamber. Each extension and the associated metering chamber supports a filling unit with a twin-seat valve having a single valving element which is movable between an upper position to seal an outlet at the lower end of the extension from an adjacent inlet of the metering chamber while permitting the outlet of the metering chamber to discharge a metered quantity of liquid into a container below the filling unit, and a lower position in which the single valving element seals the outlet of the metering chamber but permits the extension to admit liquid into the metering chamber. The mechanism for moving the valving element between its upper and lower positions independently of the speed of the vessel employs a spring which biases the valving element to its upper position when the underside of the valving element is acted upon by atmospheric pressure, and a mechanical flip-flop which can lower the valving element against the resistance of the spring. Flow restrictors are provided to limit leakage of the liquid during movement of the valving element between its positions.

19 Claims, 4 Drawing Sheets

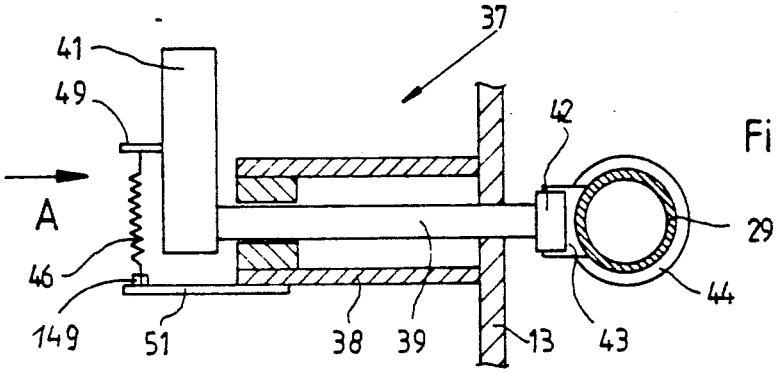
Fig. 3
Fig. 4a
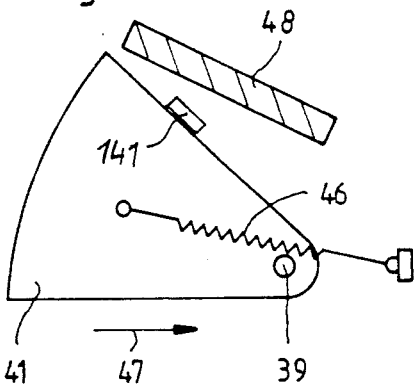
Fig. 4b
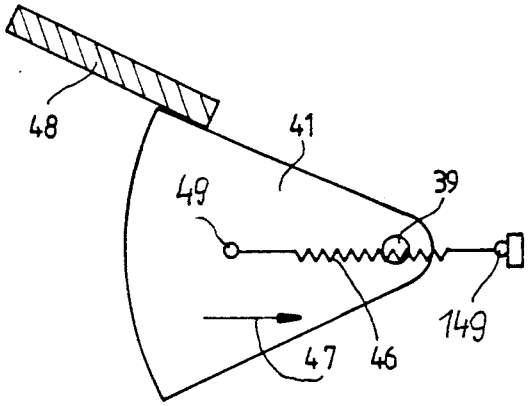
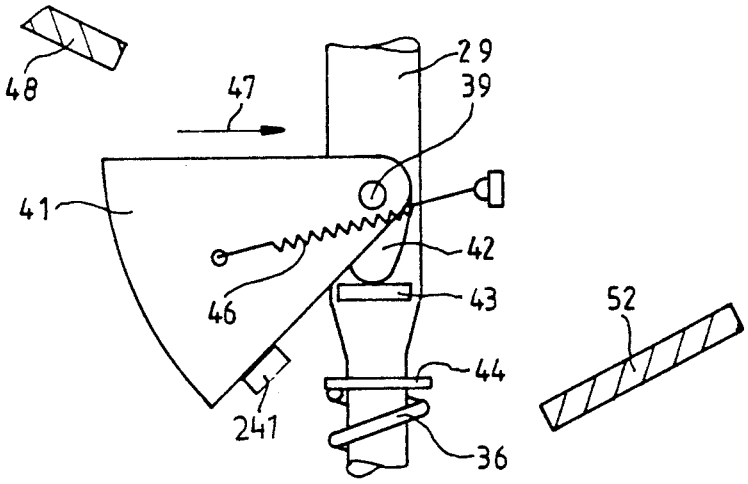
Fig. 4c

APPARATUS FOR ADMITTING METERED QUANTITIES OF LIQUID INTO BOTTLES OR OTHER CONTAINERS

CROSS-REFERENCE TO RELATED CASES

Commonly owned copending patent application Ser. No. 07/542,719 of Walusiak discloses an apparatus for filling containers. FIG. 3 shows one mode of supplying containers to filling units which are orbited by a rotary vessel. The application of Walusiak further describes and shows various types of combined container centering and sealing devices which can be used in container filling units.

Commonly owned copending patent application Ser. No. 07/568,254 of Mette discloses a method of and an apparatus for filling containers with pressurized liquids. FIG. 1 of the application of Mette shows the manner of delivering empty containers to and for removing filled containers from filling units which are orbited by a rotary vessel for a supply of pressurized liquid.

Commonly owned copending patent application Ser. No. 07/562,486 of Mette discloses an apparatus for filling bottles and the like, and more particularly a special mode of sealing the open ends of containers during admission of metered quantities of a pressurized liquid.

Commonly owned copending patent application Ser. No. 07/568,257 of Fiwek et al. discloses a method of and an apparatus for filling and capping containers for beverages and the like. The invention resides in the application of caps to filled containers.

Commonly owned copending patent application Ser. No. 07/568,273 filed Aug. 15, 1990 by Manfred Mette for "Apparatus for filling bottles and the like", now U.S. Pat. No. 5,125,440, granted Jun. 30, 1992, discloses an apparatus for filling bottles and the like. The apparatus of the present invention constitutes an improvement over and a further development of the apparatus of Mette. The disclosure of the patent to Mette is incorporated herein by reference.

BACKGROUND OF THE INVENTION

The invention relates to improvements in apparatus for filling bottles, cans and/or other types of containers with metered quantities of liquids, e.g., with metered quantities of carbonated beverages. More particularly, the invention relates to improvements in apparatus wherein a beverage or another liquid is normally admitted into pressurized containers and a supply of beverage is stored in a vessel wherein the beverage is maintained at an elevated pressure.

It is already known to provide a container filling apparatus with a liquid-containing vessel which carries at least one metering chamber and at least one filling unit which effects the flow of a metered quantity of liquid from the chamber into a container, e.g., into a bottle which is designed to store a carbonated beverage. Reference may be had to the aforementioned commonly owned copending patent application Ser. No. 07/568,273 of Mette. The filling unit comprises a first valve which can be actuated to effect the flow of liquid from the vessel into the metering chamber, and a second valve which can be actuated to effect the flow of a metered quantity of liquid from the chamber into an empty container. The metering chamber carries or is adjacent a combined container centering and sealing device which is effective during admission of a metered quantity of liquid from the chamber into the container.

Carbonated beverages are often stored in a vessel wherein a supply of liquid is confined beneath a cushion of compressed gas. A regulating device is provided to ensure that the level of pressurized liquid in the vessel is substantially constant in order to establish optimum circumstances for the transfer of liquid from the vessel into one or more metering chambers. In many instances, the vessel constitutes an annular tank which is rotatable about a vertical axis and surrounds the means for admitting liquid into its interior. The vessel carries an annulus of equidistant filling units each of which comprises two valves and a combined container centering and sealing device. Such apparatus can be used, for admission into bottles, cans or other types of containers, a non-carbonated liquid (e.g., milk, water, a juice or a wine) or a carbonated beverage which must be admitted at an elevated pressure. The necessary equipment for admission of carbonated or non-carbonated beverages is incorporated into each filling unit. Reference may be had, for example, to published German patent application No. 30 25 786 or 22 57 449. The last named published German patent application describes an apparatus wherein a mobile vessel carries a set of metering chambers and filling units which can be actuated to admit liquid from the vessel into the respective metering chambers. The valves which form part of the filling units and serve to admit liquid from the vessel into the metering chambers extend into the vessel. The outlet of each metering chamber is adjacent a combined container centering and sealing device and is controlled by a second valve of the respective filling nit. The two valves of each filling unit are actuatable, independently of each other, by cams which are adjacent the path of movement of the vessel. The arrangement is such that the speed at which the valves of each filling unit open or close depends upon the speed of movement of the vessel.

A drawback of the just described apparatus is that the filling units are complex, bulky and expensive. Moreover, the vessel must be designed to confine certain component parts of each filling unit. Another drawback of such apparatus is that the metering chambers receive liquid from above; consequently, the gas which is confined in a metering chamber prior to admission of liquid from the vessel must be expelled by bubbling through the inflowing liquid. Therefore, such apparatus cannot be used for admission of metered quantities of carbonated beverages into bottles, cans or other types of containers.

OBJECTS OF THE INVENTION

An object of the invention is to provide a simple and inexpensive apparatus which can be used to transfer metered quantities of a liquid, such as a carbonated beverage, from a vessel into a series of successive containers in the form of bottles, cans or the like.

Another object of the invention is to provide the apparatus with novel and improved means for effecting the transfer of metered quantities of a liquid from a source into one or more metering chambers and from the metering chamber or chambers into empty containers.

A further object of the invention is to provide the above outlined apparatus with novel and improved filling units.

An additional object of the invention is to provide improved filling units of the type described and shown in commonly owned copending patent application Ser. No. 07/568,273 to Mette.

Still another object of the invention is to provide the above outlined apparatus with novel and improved means for preventing leakage of excessive quantities of fluid during certain stages of the container filling operation.

An additional object of the invention is to provide a novel and improved method of transferring liquid from a source into one or more metering chambers and from such metering chamber or chambers into successive empty containers.

A further object of the invention is to provide an apparatus wherein the rate of liquid flow to and from the metering chamber or chambers is not dependent upon the speed of movement of the vessel for a supply of liquid along its path.

Another object of the invention is to provide an apparatus which can admit highly accurately metered quantities of a liquid medium into bottles, cans or other types of containers.

An additional object of the invention is to provide the above outlined apparatus with novel and improved means for actuating the valves of container filling, centering and sealing units.

SUMMARY OF THE INVENTION

The invention is embodied in an apparatus for filling successive containers of a series of containers with metered quantities of a liquid, such as acarbonated beverage. The improved apparatus comprises a vessel which is arranged to store a supply of liquid and has at least one first outlet, liquid metering means including at least one liquid metering chamber having an inlet arranged to receive liquid from the at least one first outlet and a second outlet for admission of metered quantities of liquid into successive containers, and container filling means including at least one filling unit having a valve with a component movable between a first position in which the at least one first outlet is sealed to prevent the flow of liquid from the vessel into the at least one metering chamber and the second outlet is open to permit a metered quantity of liquid to flow from the at least one metering chamber into a container, and a second position in which the second outlet is sealed and the at least one first outlet is open to permit the liquid to flow from the vessel into the at least one metering chamber. The at least one filling unit further comprises means for moving the component of the valve between the first and second positions.

The vessel is preferably movable in a predetermined direction (most preferably rotatable about a fixed vertical axis) and preferably comprises a plurality of first outlets. The metering means then comprises a metering chamber for each first outlet, and the filling means comprises a discrete filling unit (with its own valve) for each metering chamber. The filling units are mounted on the movable vessel and are preferably at least substantially equidistant from one another in the predetermined direction.

The vessel comprises a bottom wall and can comprise a plurality of fluid-conveying (e.g., tubular) extensions which are provided on and extend downwardly from the bottom wall. Each extension extends into a discrete metering chamber and the first outlets are then provided at the lower ends of the extensions. The metering chambers have portions which are adjacent the outlets of the respective extensions of the vessel, and the second outlets are provided in such portions of the metering chambers.

The aforementioned component of each valve preferably includes or constitutes a single valving element.

The moving means for the component of each valve can constitute a flip-flop. In accordance with a presently preferred embodiment, the moving means for each component includes means (e.g., a coil spring) for biasing the respective component to one of the first and second positions and means for shifting the component to the other position against the opposition of the biasing means. Each moving means is preferably designed to move the respective component between its first and second positions at a speed which is independent of the speed of movement of the vessel and of the filling unit or units (which share the movements of the vessel).

The shifting means of each moving means can comprise a follower which is (operatively) connected with the respective component, and at least one stationary cam which is adjacent the path of movement of each valve with the vessel and is engageable by the follower during movement of the follower along a predetermined portion of the path. Each follower is preferably pivotable about a predetermined axis between a first end position in which the respective biasing means is free to maintain the corresponding component in the one position, and a second end position in which the corresponding component is maintained in the other position. Each such moving means can further comprise resilient means (e.g., a tension spring) for yieldably urging the associated follower at least to the second end position. The arrangement is preferably such that each follower is movable through an intermediate dead-center position and the resilient means is operative to urge the follower to the second end position when the follower completes a movement from the first end position to and at least slightly beyond the intermediate position, and to urge the follower to the first end position when the follower completes a movement from the second end position to and at least slightly beyond the intermediate position.

The apparatus preferably comprises at least one flow restrictor for each metering chamber. The at least one flow restrictor is adjacent the path of movement of the respective component between its first and second positions to at least reduce the leakage of liquid from the vessel and/or from the respective metering chamber during movement of the component along its path between the first and second positions. The at least one flow restrictor can be provided on the vessel or on the respective metering chamber. The at least one flow restrictor can comprise an annular skirt which is provided on the vessel or on the respective metering chamber and defines with the respective component an annular clearance, at least during one or more predetermined stages of movement of the component between its first and second positions. The arrangement is preferably such that each component includes a cylindrical peripheral surface and the at least one flow restrictor comprises a first annular skirt which is provided on the vessel and defines with the peripheral surface a first annular clearance or gap at least in or close to the first position of the component, and a second annular skirt provided on the respective chamber and defining with the peripheral surface a second annular clearance or gap at least in or close to the second position of the component. The component is surrounded by the first and second skirts during a certain stage of movement between its first and second positions, e.g., midway between such positions.

Each valve preferably comprises a first annular seat on the vessel and a second annular seat on the respective metering chamber. The component of such valve has a first sealing surface (e.g., a first frustoconical surface) which engages the first seat in the first position of the component, and a second sealing surface (e.g., a second frustoconical surface) which engages the second seat in the second position of the component. The first and second outlets are open at least during a predetermined stage of movement of the respective component between its first and second positions; this is the reason for the provision of at least one flow restrictor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 3 is an enlarged fragmentary horizontal sectional view substantially as seen in the direction of arrows from the line III—III in FIG. 1;

FIG. 4*a* is a view as seen in the direction of arrow A in FIG. 3 and shows the follower of shifting means for a component in one end position;

FIG. 4*b* shows the structure of FIG. 4*a* but with the follower in or close to its intermediate dead-center position;

FIG. 4*c* illustrates the structure of FIG. 4*a* or 4*b* but with the follower in the other end position.

DESCRIPTION OF PREFERRED EMBODIMENTS

Figure 1:
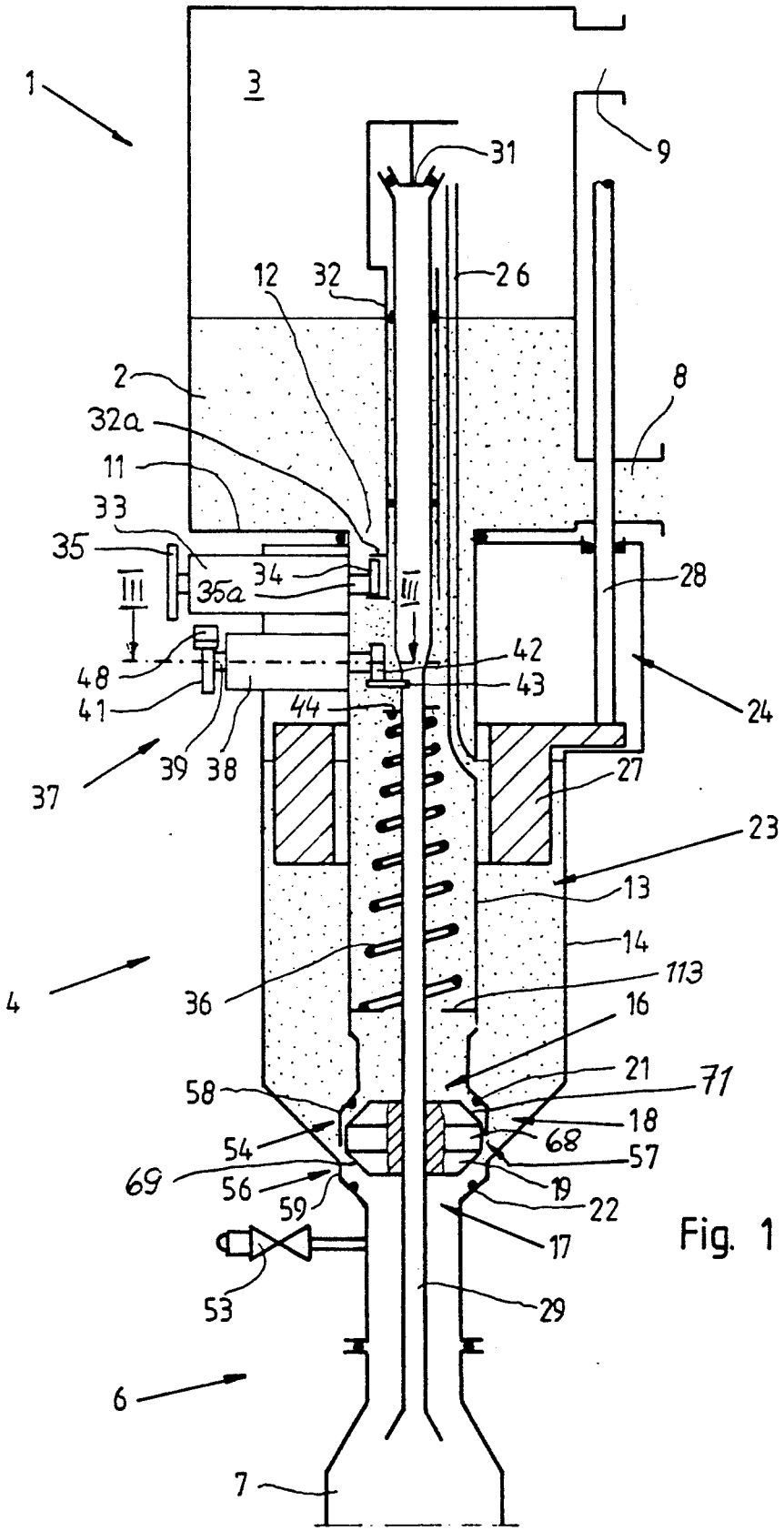
FIG. 1 is a schematic fragmentary vertical sectional view of a filling apparatus which embodies one form of the invention, the component of the valve forming part of the illustrated filling unit being shown between its first and second positions.

FIG. 1 shows a portion of an apparatus which comprises an annular vessel 1 which serves to store a supply of liquid 2 to be admitted into successive containers 7. The container shown in the lower portion of FIG. 1 is a bottle which can be moved into register with one of several filling units 4 (one shown in FIG. 1) in a manner as disclosed in the aforementioned commonly owned copending patent applications. The supply of liquid 2 is stored beneath a cushion 3 of gas (e.g., air or carbon dioxide) which fills the upper portion of the vessel 1. The latter is movable (normally rotatable) along a predetermined path (normally along a circular path about a vertical axis which is located to the right of FIG. 1). The bottom wall 11 of the vessel 1 carries a ring-shaped set or group of equidistant filling units 4 each of which has a combined container centering and sealing device 6. The reference character 8 denotes in FIG. 1 a conduit which serves to supply liquid 2 at a rate such that the level of liquid in the vessel 1 is at least substantially constant. A conduit 9 is provided to supply gas to the cushion 3 above the supply of liquid 2 at a rate such that the pressure of gas in the vessel 1 is at least nearly constant. This establishes predictable circumstances for transfer of accurately metered quantities of liquid into discrete containers 7. The main sources of supply of liquid and gas are, or can be, located in the space which is surrounded by the annular vessel 1. The conveyor or conveyors for delivery of empty containers 7 into register with successive filling units 4 and for removal of successive filled containers 7 from positions of alignment with the filling units 4 are of known design and are not shown in the drawing. Reference may be had again to the aforementioned commonly owned copending patent applications.

The bottom wall 11 of the vessel 1 has a set of equidistant openings 12, one for each filling unit 4 and each serving to admit liquid 2 into a discrete tubular (e.g., cylindrical) extension 13 of the vessel. The extensions 13 can constitute integral parts of the bottom wall 11 or are welded or otherwise sealingly secured thereto. Each extension 13 projects downwardly into a discrete metering chamber 14 which shares all movements of the vessel 1 about the vertical axis. The outlet 16 at the lower end of each extension 13 serves to admit liquid 2 into the respective metering chamber 14 from below when a twin-seat valve 18 of the respective filling unit 4 is set to permit liquid to flow from the vessel 1 by way of the corresponding extension 13. Each extension 13 and the corresponding metering chamber 14 preferably constitute a preassembled module. This renders it possible to utilize a relatively simple and inexpensive vessel 1 with a bottom wall 11 having an annulus of equidistant openings 12 for admission of liquid into the corresponding extensions 13.

The lower portion of each metering chamber 14 is adjacent the outlet 16 of the respective extension 13 and is provided with a second outlet 17 which is controlled by the valve 18 of the respective filling unit 4 and serves to admit metered quantities of liquid 2 into the registering containers 7. The exact construction of the combined centering and sealing device 6 which is a constituent of each filling unit 4 forms no part of the present invention. It suffices to say that, when an empty container 7 is properly aligned with the respective filling unit 4, the corresponding centering and sealing device 6 is effective to seal the open upper end of the container from the surrounding atmosphere and to maintain the thus sealed open upper end in an optimum position for reception of a metered quantity of liquid from the respective metering vessel 14.

The illustrated metering chamber 14 comprises a liquid-receiving metering compartment 23 and a gas-receiving upper compartment 24. The cushion of gas in the compartment 24 is located directly on top of the quantity of liquid 2 which enters the compartment 23 by way of the outlet 16 of the extension 13 when the movable component 19 of the valve 18 is in a lower position to seal the outlet 17 of the chamber 14 from the atmosphere and from the container 7 which is engaged by the combined centering and sealing device 6 of the filling unit 4. A gas conveying conduit 26 is provided to establish communication between the upper end of the compartment 23 and the cushion 3 of gas in the upper portion of the vessel 1. The compartment 24 of the metering chamber 14 is sealed from the surrounding atmosphere so that the body of gas therein constitutes a cushion or buffer serving to limit the quantity of liquid which can enter the compartment 23 from below, namely by way of the outlet 16 when the outlet 17 is sealed by the component 19 of the valve 18. This component 19 is a one-piece or composite single valving element which is movable up and down with an elongated upright gas-conveying pipe 29 connecting the interior of a container 7 below the filling unit 4 with the cushion 3 of gas above the supply of liquid 2 in the vessel 1.

The metering chamber 14 contains a vertically adjustable annular plunger-like displacing element 27 which can alter the quantity of liquid in the metering chamber and is movable up and down by an elongated adjusting rod 28 extending upwardly through the top wall of the chamber 14 and into the space within the radially inner wall of the annular vessel 1. Such mounting of the adjusting rod 28 ensures that the installation of this rod in the metering chamber 14 and its movability to adjust the level of the displacing element 27 in the chamber 14 do not necessitate any alterations of the relatively simple annular vessel 1.

The twin-seat valve 18 including the reciprocable component or valving element 19 includes a first seat 21 which is provided beneath a cylindrical skirt 58 at the lower end of the extension 13, and a second seat 22 which is provided in the lower portion of the metering chamber 14 beneath a cylindrical skirt 59. The skirts 58, 59 are coaxial and respectively constitute the elements of a first flow restrictor 54 on the extension 13 and a second flow restrictor 56 on the lower portion of the metering chamber 14. The component 19 engages the seat 21 when the outlet 16 is sealed but the outlet 17 is open, and the component 19 engages the seat 22 when the outlet 17 is sealed but the outlet 16 is open. The component 19 has an upper frustoconical surface 71 which can sealingly engage the seat 21, and a lower frustoconical surface 69 which can sealingly engage the seat 22. The two frustoconical surfaces 69, 71 are separated from each other by a cylindrical peripheral surface 68 which cooperates with the skirt 58 to form the flow restrictor 54 or with the skirt 59 to form the flow restrictor 56.

The upper end portion of the gas conveying pipe 29 is provided with a valve 31 which can be opened during a certain stage of container filling operation to admit pressurized gas from the cushion 3 in the vessel 1 into an empty container 7 below the filling unit 4. The means for opening or closing the valve 31 comprises a sleeve 32 which preferably concentrically surrounds the pipe 29 in the vessel 1 and can be moved up and down by an actuator 33 which is operated by a stationary cam or toothed rack adjacent the path of movement of the vessel 1 about its vertical axis. To this end, the actuator 33 includes an eccentric 34 which extends into a socket **32*a* of the sleeve 32**.

The means for moving the component 19 of the twin-seat valve 18 between the first and second positions comprises an energy storing element 36 in the form of a coil spring which biases the component 19 to its upper position in which the frustoconical surface 71 engages the seat 21 of the extension 13. The movement means further comprises a shifting mechanism 37 which can be said to constitute a mechanical flip-flop and serves to move the component 19 from engagement with the seat 21 toward and into engagement with the seat 22 against the opposition of the coil spring 36. The lower end convolution of the spring 36 reacts against an internal retainer 113 of the extension 13, and the topmost convolution of this spring bears against an external retainer or abutment 44 (see also FIGS. 3 and **4*c*) on the pipe 29 (which is rigid with the component 19**).

The component 19 is normally maintained in the position of sealing engagement with the lower seat 22 because the pressure of liquid 2 in the extension 13 (i.e., in the vessel 1) suffices to overcome the bias of the spring 36 when the pressure beneath the component 19 (i.e., in the container 7 which is engaged by the combined sealing and centering device 6 or in the tubular lower end portion of the metering chamber 14) matches the atmospheric pressure. However, when the pressure in the container 7 below the filling unit 4 rises as a result of opening of the valve 31 (which then admits compressed gas from the cushion 3, via pipe 29 and into the container 7 which is sealed from the atmosphere by the device 6), the bias of the spring 36 can suffice to expose the outlet 17 while simultaneously sealing the outlet 16 so that a metered quantity of liquid 2 can flow from the chamber 14 into the container 7 while the chamber 14 is sealed from the column of liquid 2 in the extension 13.

The shifting mechanism 37 can move the component 19 away from the seat 21 (against the opposition of the spring 36) when the pressure below the component 19 matches atmospheric pressure. A bearing housing 38 of the mechanism 37 is affixed to the respective extension 13 and rotatably mounts a horizontal shaft 39 for an eccentric sector-shaped follower 41 (see also FIGS. 3 and **4*a* to 4*c*). The follower 41 is affixed to the outer end of the shaft 39, and the inner end of this shaft carries an eccentric pusher 42 which can displace the tube 29 and the component 19 against the opposition of the spring 36 by way of a platform or lug 43 affixed to adjacent portion of the tube 29**.

The follower 41 is pivotable about the axis of the shaft 39 between first and second end positions which are determined by suitable stops 141 and 241 (shown in FIGS. **4*a* and 4*c*, respectively). A resilient element in the form of a helical tension spring 46 (shown in FIGS. 3 and 4*a*–4*c*) serves to yieldably urge the eccentric follower 41 against the stop 141 or against the stop 241, depending upon in which direction the follower 41 has been advanced from its end position toward and at least slightly beyond the dead-center intermediate position of FIG. 4*b*. One end convolution of the tension spring 46 is affixed to a post or pin 49 on the follower 41 and the other end convolution of this spring is secured to a pin 149 on a holder 51 which is affixed to the housing 38 of the shifting mechanism 37. FIGS. 4*a* to 4*c* show that the shifting mechanism 37 is a mechanical flip-flop because its follower 41 invariably assumes the end position of FIG. 4*a* or the end position of FIG. 4*c* (both under the action of the tension spring 46) as soon as the follower 41 advances beyond the (unstable) intermediate dead-center position on its way from the position of FIG. 4*a* toward the position of FIG. 4*c*** or in the opposite direction.

The arrow 47 denotes in FIG. **4*a* the direction of movement of the follower 41 (which dwells in one of its end positions under the bias of the tension spring 46) in response to rotation of the vessel 1 about the vertical axis. The follower 41 is held in the one end position by the spring 46 in cooperation with the stop 141. As the follower 41 moves in the direction of arrow 47, it strikes and is pivoted in a counterclockwise direction by a stationary cam 48 which is adjacent the path of movement of successive filling units 4 along their path about the vertical axis for the rotary vessel 1. The cam 48 is positioned in such a way that it pivots the follower 41 in a counterclockwise direction (about the axis of the shaft 39) to and beyond the unstable intermediate position of FIG. 4***b*. The first half of movement of the follower 41 from the end position of FIG. 4*a* takes place against the opposition of the tension spring 46, i.e., this spring then stores energy but is free to dissipate the stored energy and to propel the follower 41 from the intermediate position of FIG. 4*b* to the end position of FIG. 4*c* (i.e., against the stop 241) as soon as an imaginary line connecting the axes of the pins or posts 49, 149 in FIG. 4*b* is located beneath the axis of the shaft 39. It will be seen that, whereas the interval which elapses to pivot the follower 41 from the end position of FIG. 4*a* to the intermediate position of FIG. 4*b* is a function of the speed of the vessel 1 about the vertical axis, the duration of the interval which elapses to move the follower 41 from the intermediate position of FIG. 4*b* to the end position of FIG. 4*c* is not dependent upon the speed of the vessel 1 but solely upon the bias of the spring 36 (which opposes the movement of the follower 41 to the end position of FIG. 4*c*) and spring 46 (which propels the follower 41 from the position of FIG. 4*b* to that which is shown in FIG. 4*c*).

The means for returning the follower 41 from the end position of FIG. 4*c* to the end position of FIG. 4*a* comprises a second stationary cam 52 which is adjacent the path of movement of the follower 41 when the filling of the chamber 14 with a metered quantity of liquid 2 is completed so that the follower 41 moves back from the position of FIG. 4*c* toward and beyond the position of FIG. 4*b*. The first stage of such movement (toward the intermediate position) is resisted by the springs 46 but this spring thereupon propels the follower 41 back to the end position of FIG. 4*a* as soon as the follower has advanced beyond the dead-center intermediate position of FIG. 4*b* (i.e., when the line connecting the axes of the pins or posts 49, 149 is located above the axis of the shaft 39, as viewed in FIG. 4*b*). The speed of movement of the follower 41 from the end position of FIG. 4*c* back toward the intermediate position of FIG. 4*b* (i.e., under the action of the cam 52) is dependent upon the speed of the vessel 1 about its vertical axis. However, the speed of movement of the follower 41 from the intermediate position of FIG. 4*b* back to the end position of FIG. 4*a* is dependent solely upon the bias of the tension spring 46; at any rate, the speed of movement of the vessel 1 does not influence the second stage of movement of the follower 41 from the end position of FIG. 4*a* to the end position of FIG. 4*c* or in the opposite direction.

As explained above, the component 19 of the valve 18 is located in its lower position (in which the outlet 17 is sealed and the outlet 16 is open) when the combined centering and sealing device 6 of the filling unit 4 does not engage the open top of a container 7 (i.e., when the underside of the component 19 is maintained at atmospheric pressure). Thus, the frustoconical sealing surface 69 of the component 19 engages the annular seat 22 and liquid 2 is free to flow from the vessel 1, through the extension 13, outlet 16 and into the metering chamber 14. At such time, the relatively high pressure of liquid 2 in the extension 13 suffices to overcome the bias of the spring 36 and to maintain the component 19 of the valve 18 in the lower end position.

The valve 31 at the upper end of the gas conveying pipe 29 is closed when the pressure in the metering chamber 14 beneath the component 19 equals or approximates atmospheric pressure. This is desirable and advantageous because the pipe 29 cannot permit escape of pressurized gaseous fluid from the upper part (cushion 3) of the vessel 1 into the surrounding atmosphere (by way of the valve 31 and pipe 29). This ensures that the pressure of gas which forms the cushion 3 cannot decrease to any appreciable extent when a filled container 7 is being removed from a position of alignment with the combined centering and sealing device 4 or when no container is in register with the lower end portion of the metering chamber 14.

It is now assumed that a freshly filled container 7 has been removed from the position of engagement by the combined centering and sealing device 6 and that the lower end portion of the metering chamber 14 is open to the atmosphere. The component 19 of the valve 18 engages the seat 22 because the pressure of liquid 2 in the extension 13 of the vessel 1 suffices to overcome the resistance of the spring 36. The vessel 1 is driven to rotate about the vertical axis and the filling unit 4 is advanced to the station where a fresh (empty) container 7 is delivered to have its open upper end sealingly engaged by the device 6. A stationary cam or a toothed rack which is adjacent the path of movement of the follower 35 on the shaft 35*a* for the eccentric 34 causes the eccentric 34 to turn and to induce the socket 32*a* to raise the sleeve 32 and to thus open the valve 31 at the top of the pipe 29. Compressed gas is then free to flow from the cushion 3 in the vessel 1 into the empty container 7 beneath the filling unit 4. The force with which the column of liquid 2 in the extension 13 urges the component 19 against the lower seat 22 is reduced to zero as soon as the pressure in the container 7 rises to match the pressure of the cushion 3 in the vessel 1. At such time, the bias of the spring 36 suffices to lift the surface 69 of the component 19 off the seat 22 and to move the surface 71 into sealing engagement with the seat 21, i.e., the outlet 17 is open and the outlet 16 is sealed. A metered quantity of liquid 2 is then free to descend from the chamber 14 into the container 7 whereby the descending metered quantity of liquid expels gas from the interior of the container 7 into the pipe 29, i.e., back into the upper portion of the vessel 1.

The vessel 1 continues to rotate about the vertical axis and the follower 47 of the shifting mechanism 37 on the extension 13 advances in the direction of arrow 47 (FIG. 4*a*). When the transfer of a metered quantity of liquid 2 from the chamber 14 into the container 7 is completed, the follower 41 reaches the cam 48 and is pivoted against the resistance of the tension spring 46 to move from the end position of FIG. 4*a* to and beyond the intermediate position of FIG. 4*b*. The spring 46 (which has stored energy during movement of the follower 41 from the position of FIG. 4*a* to the position of FIG. 4*b*) is then free to abruptly dissipate energy and to propel the follower 41 to the end position of FIG. 4*c*. The eccentric 42 causes the pipe 29 to descend and to move the component 19 into sealing engagement with the seat 22 not later than when the pivoting of the follower 41 to the end position of FIG. 4*c* is completed. The action of the tension spring 46 to maintain the component 19 in sealing engagement with the seat 22 is assisted by pressurized liquid in the extension 13 as soon as the pressure in the chamber 14 and in the extension 13 rises sufficiently to counteract the tendency of the spring 36 to maintain the component 19 in sealing engagement with the seat 21.

Once the pressure in the extension 13 has risen sufficiently to ensure that the pressure of the column of liquid 2 in the extension 13 plus the pressure of liquid in the filled chamber 14 suffices to overcome the bias of the spring 36, the eccentric 41 of the shifting mechanism 37 is ready to return to the end position of FIG. 4*a*. At such time, the follower 41 reaches and is pivoted by the stationary cam 52 which causes the follower to leave the end position of FIG. 4*c*, to move to and beyond the intermediate position of FIG. 4*b* (with attendant stressing of the tension spring 46) and to thereupon abruptly advance to the position of FIG. 4*a* (under the action of the spring 46). The eccentric 42 is then spaced apart from the platform 43 of the pipe 29 and enables the spring 36 to move the pipe 29 and the component 19 upwardly to seal the outlet 16 and to expose the outlet 17.

When the transfer of a metered quantity of liquid 2 from the chamber 14 into a container 7 is completed, the outlet 17 is sealed again and the outlet 16 is exposed at the same time to permit refilling of the chamber 14 with a fresh quantity of liquid 2. The cushion of gas in the upper compartment 24 of the chamber 14 ensures that this chamber receives an accurately metered quantity of liquid 2 while the outlet 16 is exposed.

The valve 31 at the upper end of the pipe 29 is closed in response to or simultaneously with closing of the outlet 17. Such closing of the valve 31 can take place simultaneously with opening of a relief valve 53 which is mounted on the lower end portion of the metering chamber 14 and reduces the pressure in the lower end portion of the chamber 14 prior to movement of a freshly filled container 7 from a position of engagement with the combined centering and sealing device 6 of the filling unit 4. The relief valve 53 can be temporarily opened by a stationary cam or trip which is adjacent the path of movement of the relief valve with the vessel 1 and metering chamber 14.

As already described above, the tension spring 46 serves to actually move the component 19 into sealing engagement with the seat 22, i.e., to a position in which the outlet 17 of the metering chamber 14 is sealed. The spring 36 serves to move the component 19 to the other position (of engagement with the seat 21) subsequent to movement of the follower 41 back to the end position of FIG. 4*a* and when the pressure beneath the component 19 is sufficiently low to enable the spring 36 to expand by reacting against the retainer 113 while bearing against the retainer 44. Thus, not only the movement of the component 19 against the seat 22 but also the movement of the component 19 against the seat 21 is independent of the speed of rotational movement of the vessel 1. This ensures the establishment of predictable and accurately reproducible circumstances for each of a short or long series of filling operations.

FIG. 1 shows that the component 19 need not slidably engage one or more resilient sealing elements and need not carry one or more friction generating sealing elements during movement between its positions of engagement with the seat 21 or 22. Some elastic sealing means can be provided in or on the seats 21, 22 and/or on the frustoconical sealing surfaces 69 and 71. The outlet 16 is preferably open as soon as the frustoconical surface 71 begins to move away from the seat 21, i.e., before the outlet 17 is sealed as a result of engagement of the frustoconical surface 69 with the seat 22. The quantity of liquid which leaks from the extension 13 by way of the outlet 16 during movement of the component 19 from sealing engagement with the seat 21 into sealing engagement with the seat 22 does not adversely influence the liquid metering operation because the speed of movement of the component 19 into engagement with the seat 21 or 22 is known in advance (i.e., it is not influenced by the speed of rotary movement of the vessel 10. Therefore, the quantity of leak fluid can be calculated and taken into consideration in connection with admission of liquid from the extension 13 into the metering chamber 14. The establishment of more or less constant pressure in the upper portion of the vessel 1 and the entrapment of a given quantity of gas in the compartment 24 of the chamber 14 also contribute to predictability of the metering action.

The purpose of the aforediscussed flow restrictors 54 and 56 is to reduce, to an acceptable minimum, the quantity of liquid which leaks from the extension 13 via outlet 16 during movement of the component 19 from sealing engagement with the seat 21 toward sealing engagement with the seat 22. The flow restrictor 54 (including the skirt 58 of the extension 13) defines with the cylindrical peripheral surface 68 a first narrow annular clearance or gap 57 which receives liquid from the outlet 16. The width of the clearance or gap 57 can be selected practically at will; e.g., such clearance can be very narrow to minimize the leakage of liquid from the extension 13, namely to reduce the leakage to a value which does not affect the accuracy of the liquid metering operation with the chamber 14.

The width of the annular clearance or gap between the peripheral surface 68 of the component 19 and the skirt 59 of the metering chamber 14 can be the same as that of the clearance 57. The arrangement is preferably such that the peripheral surface 68 of the component 19 is surrounded in part by the skirt 58 and in part by the skirt 59 during a certain stage of movement of the component 19 between the seats 21, 22, e.g., while the component 19 is substantially midway between its upper and lower positions.

The wear upon the component 19 of the valve 18 is negligible because this component need not slide along seals but moves, with at least some clearance, within the skirt 58 and/or 59 all the way into sealing engagement with the seat 21 or 22. The filling unit 4 which employs the twin-seat valve 18 is simpler, less expensive and more compact and more reliable than heretofore known filling units which employ pairs of discrete valves, one for the outlet of the vessel and the other for the outlet of the metering chamber.

The mounting of the improved filling unit 4 on a rotary vessel 1 contributes to simplicity and does not affect the output of the improved apparatus because the accuracy of metering action is not dependent upon the speed of movement of the vessel. Furthermore, the filling unit 4 renders it possible to fill the metering chamber from below which is particularly desirable in connection with the filling of containers with metered quantities of carbonated beverages because the liquid is less likely to foam during admission from the extension 13 of the vessel 1 into the metering chamber. The admission of liquid into the metering chamber 14 from below is possible in spite of the fact that the flow of liquid from the vessel into a metering chamber and from the chamber into a container is controlled by a single valve.

The improved moving means 36, 37 constitutes a feature which is novel and patentable per se. Such moving means ensures reliable and rapid movements of the component 19 to the one or the other sealing position irrespective of the speed of movement of the vessel 1. In addition, the moving means 36, 37 is simple, compact and inexpensive; as stated before, the shifting mechanism 37 of such moving means can be said to constitute a very simple, compact and inexpensive but reliable and rapidly-reacting mechanical flip-flop.

The improved flow restrictors 54, 56 and a combination of such flow restrictors with the improved twin-seat valve 18 also constitute features which are novel and inventive per se. Thus, the flow restrictors render it possible to employ a single valve 18 for each filling unit 4 and to nevertheless prevent the escape of substantial quantities of liquid so that the percentage of leak liquid cannot appreciably influence the metering action. At the same time, the flow restrictors permit simultaneous flow of small quantities of liquid from the metering chamber 14 and from the associated extension 13.

Figure 5:
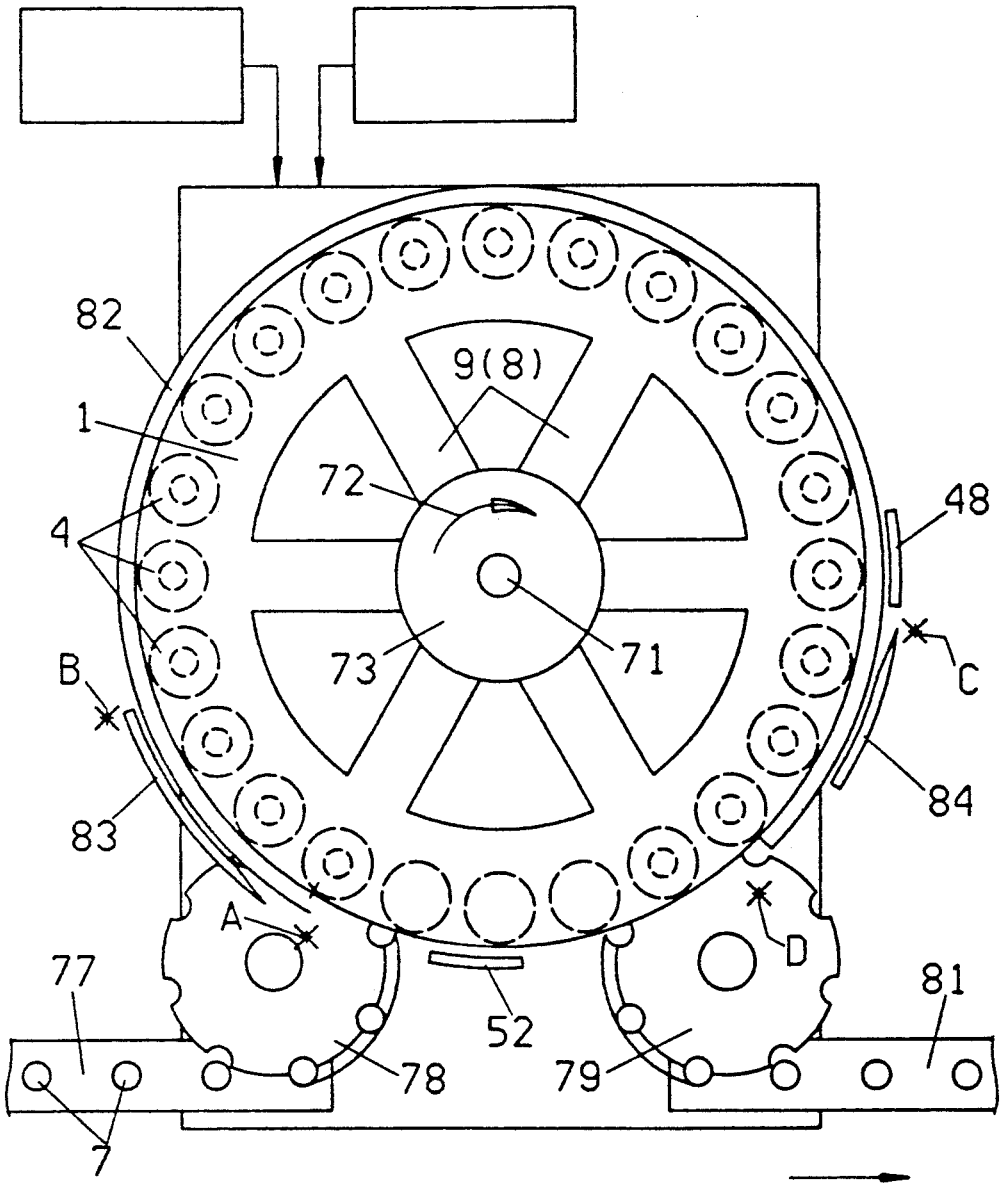
FIG. 5 is a schematic plan view of the apparatus of FIG. 1.

With reference to FIG. 5, the operation of the apparatus embodying the structure of FIGS. 1, 3 and 4*a*–4*c* is as follows:

If the filling unit shown in FIG. 1 is not engaged by the open top of a container 7, the component 19 of the valve 18 is biased against the seat 22 by the combined pressure of gas and liquid above the component 19 to ensure reliable sealing of the path for the outflow of liquid into a container. A container 7 which is delivered to the oncoming unit 4 at the point A of the endless circular path for the units 4 with the rotating vessel 1 is pressurized from within by compressed gas in response to opening of the respective valve 31 between the points A and B of the endless path. When the pressure in the empty container 7 rises sufficiently to match the pressure in the respective filling unit 4 above the component 19, the stressed coil spring 36 is free to lift the component 19 off the seat 22 and against the seat 21 so that the outlet 16 is sealed but the outlet 17 permits a metered quantity of liquid to flow from the compartment 23 into the container 7. The speed of movement of the component 19 from sealing engagement with the seat 22 into sealing engagement with the seat 21 is entirely independent of the speed of rotary movement of the vessel 1 and orbital movement of the filling units 4, and depends exclusively upon the amount of energy which is stored by the coil spring 36 at the time the component 19 is in sealing engagement with the seat 22, i.e., at the time the bias of the spring 36 upon the component 19 is overcome by the combined pressure of the gas and liquid above the component 19.

FIG. 5 shows, by way of example, a stationary cam 83 which is adjacent the path of filling units 4 between the points A and B and serves to open successive valves 31 so that the containers 7 which were delivered at the point A can be pressurized from within by compressed gas of the cushion 3 above the supply of liquid 2 in the rotating vessel 1. Filling of successive containers 7 with metered quantities of liquid which is discharged from the respective metering compartments 23 takes place between the points B and C of the endless path for the filling units 4. The stationary cam 48 is provided at or close to the point C to initiate movement of components 19 back into sealing engagement with the respective seats 22 when the admission of metered quantities of liquid into the corresponding containers 7 is completed. Such movement of successive components 19 into sealing engagement with their lower seats 22 is carried out against the opposition (i.e., with simultaneous stressing) of the associated coil springs 36, and such movement is again independent of the speed of rotational movement of the vessel 1 in spite of the utilization of the stationary cam 48 adjacent the path of movement of successive followers 41.

Successive relief valves are opened by a stationary cam 84 between the points C and D of the path for orbiting filling units 4. This results in a reduction of pressure beneath the components 19 which then engage the respective seats 22.

The next step involves disengagement of successive centering and sealing devices 6 from the adjacent freshly filled containers 7 (by means of an arcuate cam 82) which are taken over by a turnstile type transfer conveyor 79 to be delivered onto or into a further conveyor 81, e.g., for transport to a capping station.

The metering compartments 23 are refilled with metered quantities of liquid 2 from the vessel 1 (while the associated components 19 engage the respective seats 22) during orbital movement of filling units 4 from the point C back to the point A of the endless path for the units 4. Thus, an empty container 7 which is delivered at A by a turnstile type transfer conveyor 78 from a supply conveyor 77 is ready to be pressurized from within between the points A and B to be thereupon filled with a metered quantity of liquid between the points B and C in the aforedescribed manner.

The cam 52 which is adjacent the path of movement of successive filling units 4 from the point D toward the point A serves to pivot the followers 41 toward their starting positions (FIG. 4*a*) so that the eccentrics 42 permit an upward movement of the respective components 19 (on the pipes 29). The components 19 are lifted by the associated springs 36 as soon as the pressurizing of the respective empty containers 7 is completed in the aforedescribed manner, i.e., with compressed gas which flows from the cushion 3, through the then opened valves 31 and into the corresponding empty containers 7.

The various stationary cams which are shown in FIGS. 1, 3, 4*a*–4*c* and 5 are indicated very schematically; such cams can constitute groove cams, cylinder cams or any other suitable cams or at least some of these cams can be replaced by other suitable means for performing the required valve opening, valve closing and/or other operations during certain stages of orbital movements of filling units 4 with the rotating vessel 1. The exact construction of such cams or their equivalents forms no part of the present invention.

When the transfer of the contents of a metering compartment 23 into the corresponding container 7 is completed, the respective component 19 is rapidly (preferably abruptly) moved back into sealing engagement with the seat 22 so that the outlet 16 is free to admit a fresh metered quantity of liquid from the supply 2 into the freshly emptied compartment 23 (between the points C and A in FIG. 5). The cam 48 cooperates with the mechanical flip-flops 37 in order to ensure that the movements of components 19 into sealing engagement with the respective seats 22 will be at least substantially independent of the speed of rotary movement of the vessel 1 about its axis. The fixed cam 42 engages an oncoming follower 41 and causes such follower to change its angular position from that shown in FIG. 4*a* to that which is shown in FIG. 4*b*. At such time, the respective component 19 continues to sealingly engage the adjacent seat 21. Thus, the position of the component 19 relative to the seats 21, 22 does no change while the corresponding follower 41 is pivoted by the stationary cam 48, i.e., while the movement of the component 19 would be dependent upon the speed of movement of the follower 41 relative to the stationary cam 48. When the follower 41 reaches the angular position of FIG. 4*b*, the respective spring 46 takes over and propels the adjacent follower 41 from the angular position of FIG. 4*b* to the angular position of FIG. 4*c*. Such angular movement of the follower 41 entails a movement of the respective pipe 29 and hence a movement of the associated component 19 into sealing engagement with the seat 22. Thus, the pusher 42 of FIG. 4*c* is effective only while the eccentric 41 is pivoted by the corresponding spring 46 but not while the follower 41 is pivoted by the cam 48.

The cam 52 becomes effective when the pressure above the component 19 is sufficient to overcome the bias of the respective spring 36, i.e., while the spring 36 is incapable of lifting the component 19 off the adjacent seat 22. The cam 52 then pivots the follower 41 from the angular position of FIG. 4*c* back to the angular position of FIG. 4*a* but this does not affect the position of the component 19 which continues to engage the seat 22. Such pivoting of the follower 41 back to the position of FIG. 4*a* merely disengages the pusher 42 from the adjacent platform 43 so that the spring 36 is free to lift the component 19 from sealing engagement with the seat 22 into sealing engagement with the seat 21 when the pressure in the adjacent container 7 has risen sufficiently to enable the spring 36 to dissipate energy and to lift the pipe 29 which carries the component 19.

Figure 2:
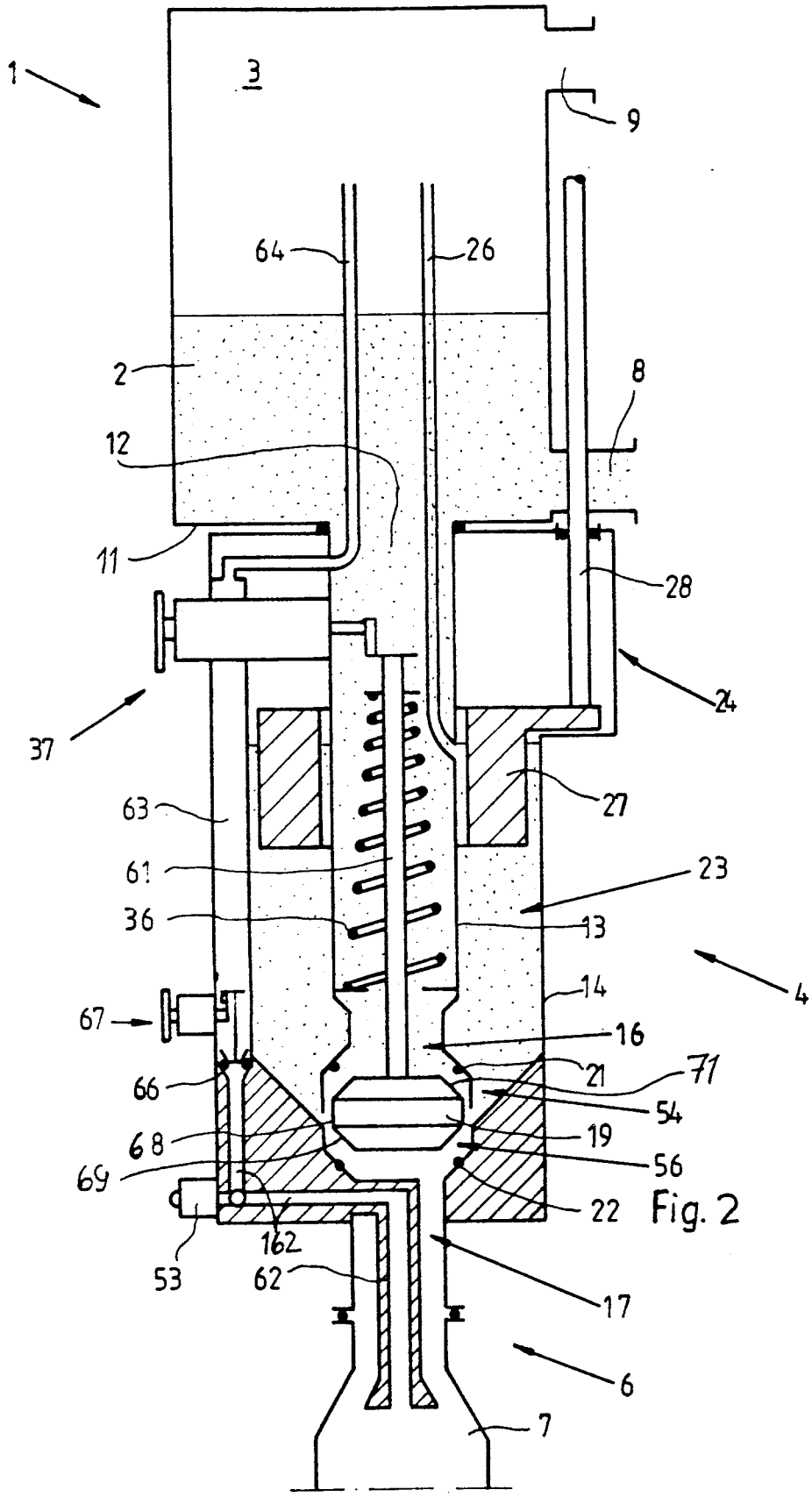
FIG. 2 is a similar fragmentary vertical sectional view of a modified filling apparatus.

FIG. 2 shows a portion of a modified apparatus. All such parts of the modified apparatus which are identical with or clearly analogous to the corresponding parts of the apparatus of FIGS. 1, 3 and 4*a*–4*c* are denoted by similar reference characters. The main difference is that the component 19 of the valve 18 in the apparatus of FIG. 2 is not mounted on and is not movable by a pipe (such as the pipe 29 of FIG. 1) which serves to establish a path for admission of compressed gas from the upper portion of the vessel 1 into an empty container 7 below the filling unit 4. The component 19 of FIG. 2 is mounted on a rod 61 which is biased upwardly (to move the component 19 into sealing engagement with the upper seat 21) by the coil spring 36 and which can be moved downwardly by a shifting mechanism 37 similar to or identical with the mechanism 37 of FIGS. 1, 3 and 4*a* to 4*c*. Thus, the mode of operation of the means 36, 37 for moving the component 19 of the twin-seat valve of FIG. 2 between the two sealing positions is the same as that of the moving means 36, 37 in the apparatus of FIG. 1.

The pipe 29 of FIG. 1 is replaced with a first pipe or conduit 62 which is rigid with the lower portion of the metering chamber 14 and extends into the open upper end of a container 7 which is engaged by the combined centering and sealing device 6 of the filling unit 4, with a channel 162 which is machined into the metering chamber 14 and communicates with the pipe 62, with a further conduit 63 in the metering chamber 14, and with a pipe 64 in the vessel 1. A valve 66 (which replaces the valve 31 of FIG. 1) is disposed between the channel 162 and the conduit 63 and is actuatable by a cam-operated mechanism 67. The pipe 64 extends upwardly through and beyond the opening 12 in the bottom wall 11 of the vessel 1 to establish communication between the conduit 63 and the cushion 3 of compressed gas in the upper portion of the vessel. The valve 66 is closed when the filling unit 4 does not engage the open top of a container 7; this prevents uncontrolled escape of gas from the upper portion of the vessel 1.

The filling unit 4 which is shown in FIG. 2 is also constructed and assembled in such a way that it can be mounted on the extension 13 of the vessel 1 or that it can be mounted on the bottom wall 11 with the extension 13 and with the metering chamber 14. Thus, the apparatus of FIG. 2 can also employ a simple and inexpensive vessel 1 for a supply of liquid 2, e.g., a carbonated beverage.

Two important advantages of the improved apparatus are its simplicity and compactness. Thus, the apparatus can employ a simple vessel 1 and simple filling units 4 each of which is equipped with a single valve 18 to control the flow of a liquid into the respective metering chamber 14 or from the metering chamber 14 into a container 7.

Another advantage of the improved apparatus is that its output is or can be higher than that of conventional apparatus because the intervals of time which are needed to effect the establishment of paths for the flow of a liquid into and from the metering chamber or chambers are not dependent upon the speed of movement of the vessel 1 about its axis. Furthermore, the apparatus is versatile in that it can be used to admit metered quantities of flowable media (such as spring water, juice, milk, carbonated beverages and/or other liquids) into larger or smaller or specially configurated containers in the form of bottles, jars, cans or the like. Still further, the apparatus can be used with particular advantage for admission of carbonated beverages into rapidly moving containers.

A further advantage of the improved apparatus is that all such parts which require frequent inspection and/or other attention are readily accessible because they are not confined in the vessel 1. This applies for the filling units 4 and their parts, for the mechanism which actuate the valves 18 and the valves 31 or 66, as well as for the mechanisms which must be actuated to change the capacity of the metering chambers 14.

Still another advantage of the improved apparatus is that the percentage of liquid which leaks during movement of a component 19 from sealing engagement with the respective seat 21 into sealing engagement with the respective seat 22 is minimal and is predictable so that it can be calculated in advance and can be fully considered in determining the quantities of liquid which are to be admitted into containers 7. The valves 18 need not be equipped with any slidable or slidably engageable sealing elements which are subject to extensive wear and require frequent replacement. Additional savings (as concerns the percentage of leak liquid) are achieved by the provision of the aforediscussed flow restrictors. These flow restrictors, together with the means for rendering the opening and closing of the valves 18 independent from the speed of the vessel 1, ensure that the accuracy of the metering action is independent of the speed of the vessel.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for filling successive containers of a series of containers with metered quantities of a liquid, such as a carbonated beverage, comprising a vessel arranged to store a supply of liquid and having outlet means including at least one first outlet; liquid metering means including at least one liquid metering chamber having an inlet arranged to receive liquid from said at least one first outlet and a second outlet for admission of metered quantities of liquid into successive containers; and container filling means including at least one filling unit having a valve with a component movable between a first position in which said at least one first outlet is sealed to prevent the flow of liquid from said vessel into said at least one chamber and said second outlet is open to permit a metered quantity of liquid to flow from said at least one chamber into a container, and a second position in which said second outlet is sealed and said at least one first outlet is open to permit the liquid to flow from said vessel into said at least one chamber, and means for moving said component between said positions, said moving means comprising means for biasing said component to one of said positions and means for shifting said component to the other of said positions against the opposition of said biasing means.

2. The apparatus of claim 1, wherein said vessel is movable in a predetermined direction and said outlet means comprises a plurality of first outlets, said metering means comprising a discrete metering chamber for each first outlet and said filling means comprising a discrete filling unit with a valve and biasing means for each of said chambers.

3. The apparatus of claim 2, wherein said vessel is rotatable about a fixed axis and said filling units are mounted on said vessel and are substantially equidistant from each other in said direction.

4. The apparatus of claim 3, wherein said vessel comprises a bottom wall and a plurality of fluid-conveying extensions provided on and extending downwardly from said bottom wall, each of said extensions extending into a discrete metering chamber an said first outlets being provided on said extensions, said metering chambers having portions adjacent the outlets of the respective extensions and said second outlets being provided in said portions of the respective chambers.

5. The apparatus of claim 2, wherein said component of each of said valves has a single valving element.

6. The apparatus of claim 1, wherein said moving means comprises a mechanical flip-flop.

7. The apparatus of claim 1, wherein said at least one filling unit is provided on said vessel and said vessel is movable in a predetermined direction, said moving means being operative to move said component between said first and second positions at a speed which is independent of the speed of movement of said vessel in said direction.

8. The apparatus of claim 7, wherein said valve is movable with said vessel along a predetermined path, said shifting means comprising a follower movable with said component and at least one stationary cam adjacent the path of and engageable by said follower.

9. The apparatus of claim 1, wherein said, shifting means comprises a follower movable with said component and pivotable about a predetermined axis between a first end position in which said biasing means is free to maintain said component in said one position and a second end position in which said component is maintained in said other position.

10. The apparatus of claim 9, wherein said shifting means further comprises resilient means for yieldably urging said follower at least to said second end portion.

11. The apparatus of claim 1, wherein said component is movable along a predetermined path on its way between said first and second positions, and further comprising at least one flow restrictor adjacent said path to at least reduce leakage of liquid during movement of said component along said path.

12. The apparatus of claim 11, wherein said at least one flow restrictor is provided on said vessel.

13. The apparatus of claim 11, wherein said at least one flow restrictor is provided on said at least one chamber.

14. The apparatus of claim 11, wherein said at least one flow restrictor comprises an annular skirt which is provided on said vessel and defines with said component an annular clearance.

15. The apparatus of claim 11, wherein said at least one flow restrictor comprises an annular skirt which is provided on said at least one chamber and defines with said component an annular clearance.

16. The apparatus of claim 11, wherein said component includes a cylindrical peripheral surface and said at least one flow restrictor comprises a first annular skirt provided on said vessel and defining with said peripheral surface a first annular clearance at least in the first position of said component, and a second annular skirt provided on said chamber and defining with said peripheral surface a second annular clearance at least in the second position of said component, said component being surrounded by said first and second skirts during movement between said first and second positions.

17. The apparatus of claim 1, wherein said valve has a first annular seat on said vessel and a second annular seat on said chamber, said component having a first sealing surface which engages said first seat in the first position of said component and a second sealing surface which engages said second seat in the second position of said component.

18. The apparatus of claim 17, wherein said first and second outlets are open at least during a predetermined stage of movement of said component between said first and second positions.

19. Apparatus for filling successive containers of a series of containers with metered quantities of a liquid, such as a carbonated beverage, comprising a vessel arranged to store a supply of liquid and having at least one first outlet; liquid metering means including at least one liquid metering chamber having an inlet arranged to receive liquid from said at lest one first outlet and a second outlet for admission of metered quantities of liquid into successive containers; and container filling means including at least one filling unit having a valve with a component movable between a first position in which said at least one first outlet is sealed to prevent the flow of liquid from said vessel into said at least one chamber and said second outlet is open to permit a metered quantity of liquid to flow from said at least one chamber into a container, and a second position in which said second outlet is sealed and said at least one first outlet is open to permit the liquid to flow from said vessel into said at least one chamber, and means for moving said component between said positions, said moving means comprising means for biasing said component to one of said positions and means for shifting said component to the other of said positions against the opposition of said biasing means, said shifting means comprising a follower movable with said component and pivotable about a predetermined axis between a first end position in which said biasing means is free to maintain said component in said one position and a second end position in which said component is maintained in said other position, said shifting means further comprising resilient means for yieldably urging said follower at least to said second end position, said follower being further movable through an intermediate dead-center position and said resilient means being operative to urge said follower to said second end position when the follower completes a movement from said first end position to and beyond an intermediate position, and to urge said follower to said first end position when the follower completes a movement from said second end position to and beyond said intermediate position.

* * * * *